US005569876A

United States Patent [19]

Podgorski

[11] Patent Number: 5,569,876

[45] Date of Patent: Oct. 29, 1996

[54] HIGH VOLTAGE INSULATING STRUCTURE

[76] Inventor: Andrew S. Podgorski, 332 Crestview Road, Ottawa, Ontario, Canada, K1H 5G6

[21] Appl. No.: 62,816

[22] Filed: May 17, 1993

[51] Int. Cl.[6] ..... H01B 7/00

[52] U.S. Cl. ..... 174/28; 174/137 R

[58] Field of Search ..... 174/137 R, 28, 174/96, 97, 98, 15.1, 15.4, 15.5, 15.6, 24, 47, 126.1

[56] References Cited

U.S. PATENT DOCUMENTS

| | | | |
|---|---|---|---|
| 2,648,719 | 8/1953 | Smith et al. | 174/28 |
| 3,604,832 | 9/1971 | Köhler et al. | 174/15.1 |
| 4,018,978 | 4/1977 | Bacvarov et al. | 174/28 |
| 4,176,238 | 11/1979 | Vulis et al. | 174/15.1 |
| 4,196,464 | 4/1980 | Russell | 174/47 X |
| 4,745,238 | 5/1988 | Kotthaus et al. | 174/28 X |

*Primary Examiner*—Morris H. Nimmo
*Assistant Examiner*—Christopher Horgan

[57] ABSTRACT

A modular, stackable insulating structure for a very high-voltage coaxial cable comprises at least three interspaced insulating tubes accommodating an inner conductor and an outer conductor of the coaxial cable. A plurality of ribs extending essentially radially along the longitudinal axis of the structure provide the spacing between adjacent tubes. The ribs are disposed in an optimized manner such that relatively effective zig-zag insulating paths are created between the inner and the outer conductors. The structure comprises cooling means.

The insulating structure may be used for the transmission of electromagnetic pulses (power peaks) at voltages in the order of megavolts with rise times in the order of picoseconds.

14 Claims, 9 Drawing Sheets

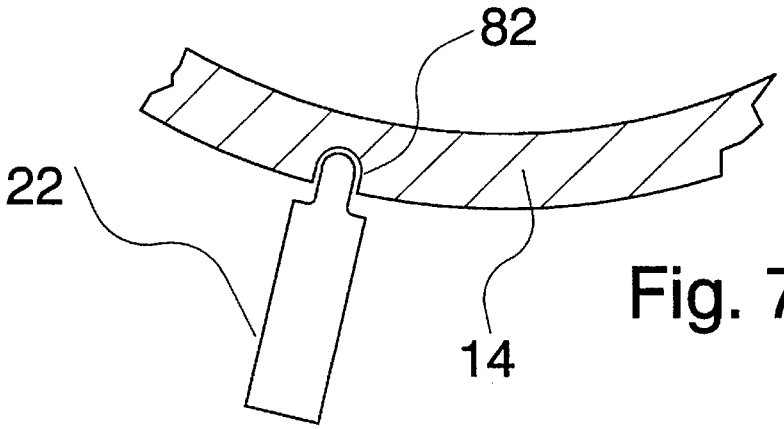
Fig. 7
Fig. 8
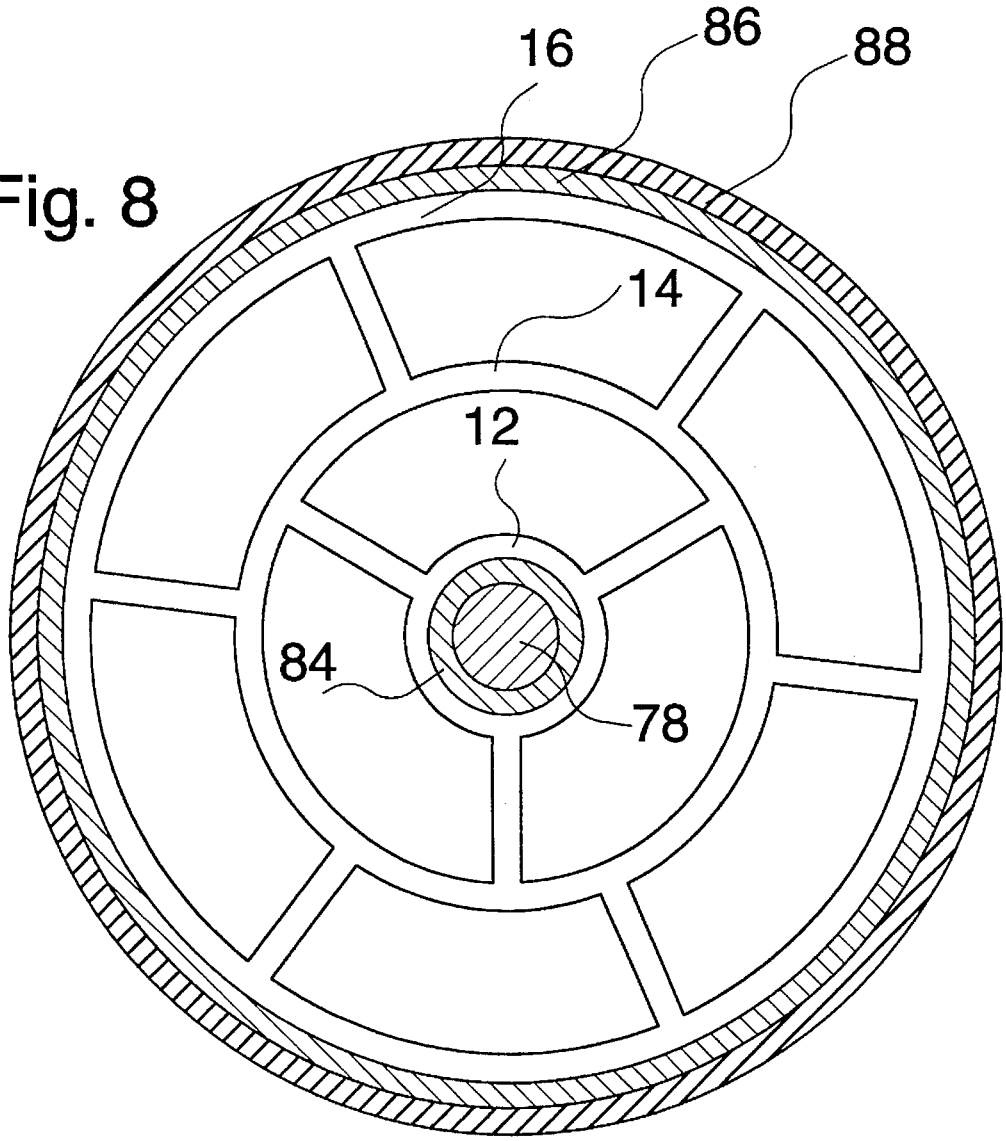

HIGH VOLTAGE INSULATING STRUCTURE

FIELD OF THE INVENTION

This invention relates to high-voltage insulation and more particularly, to an insulating multi-layer structure for high-power electrical systems which can transmit voltage pulses in the order of $10^6$ V and having rise times in the order of picoseconds.

BACKGROUND OF THE INVENTION

Transmission of energy in high power electrical systems requires the use of high-voltage (hv) insulation in coaxial lines. For special applications, some of which may not yet be practicable at this time, nonlinear insulation may have to be employed to allow for a decrease of the rise time of electromagnetic pulses generated in the above-identified conditions. As an example, generation of picosecond time domain fields in terawatt (TW) power range may be needed to effect molecular (hot) fusion.

High voltage insulation presently used in generation and transmission of energy in high power electrical systems does not, and is not required to meet the extreme requirements of the special applications mentioned above. While it is known that for linear insulating materials, the thickness and dielectric properties of insulation determine the maximum working voltage carded by the conductor protected by such insulation, the total diameter of a coaxial line for a highly concentrated transmission of the extremely short hv energy pulses is actually limited.

R is known in the art to use multi-layer insulating structures, serving also as spacer structures, for coaxial lines. Such structure is known from U.S. Pat. No. 3,469,281 to McMahon. A number of continuous or discontinuous layers of insulating material is wrapped around an inner conductor of electrical cable. The layers are separated from each other by a plurality of radially extending ribs which are wrapped helically around the conductor in the longitudinal direction.

It is also known to fill spaces created by such interspaced layers of insulation with fluids, i.e., dielectric gases, liquids or semi-liquids.

The helical arrangement of the spacers affords flexibility to the electrical cable. In the special applications above-mentioned, however, flexibility is less important while the dielectric strength and resistance to treeing and tracking ("walking"), known phenomena leading to electric breakdown of the cable (transmission system), must be maximized.

SUMMARY OF THE INVENTION

It is an object of the present invention to provide a high-voltage insulating structure capable of withstanding very high energy pulses.

It is another object of the invention to provide a high-voltage insulating structure for a coaxial cable or transmission system.

It is still another object of the invention to provide a modular stackable insulating structure which is amenable to a change of its diameter, and length.

It is yet another object of the invention to provide an insulating structure with cooling means.

It is another object of the invention to provide an insulating structure amenable to changes of its electrical parameters.

According to the invention, there is provided an insulating structure for insulating and spacing an inner conductor from an outer conductor in a manner creating relatively long radially extending insulating paths between the inner and outer conductor. The structure comprises:

a plurality of radially interspaced tubes of insulating material, disposed one inside another, including an innermost tube, an outermost tube, and at least one intermediate tube, the innermost tube surrounding said inner conductor and the outermost tube adjacent to the outer conductor, a plurality of insulating spacing supports extending between each two adjacent tubes, each support contacting said two tubes along longitudinal contact lines, said contact lines on an inner side of each intermediate tube being located substantially half-way between two nearest contact lines on the outer side of said intermediate tube.

The insulating tubes may be polygonal in cross section at least over a portion of their length. Alternatively, the tubes may be essentially circular in cross-section. It is not necessary for the tube to be disposed concentrically nor equidistantly. The spacing between the tubes may vary along their periphery in a predetermined pattern.

Preferably, the structure also comprises means for axial displacement of at least some of the tubes relative to each other.

An insulating structure of the invention may consist of a number of stackable modules. To that effect, it is preferable that the contact lines extend straight-linearly rather than helically to facilitate the assembly of the structure.

At least some of the adjacent tubes and the respective spacing supports therebetween define open channels extending along the entire length of the structure, the structure also comprising an inlet and an outlet in communication with said channels for the passage of cooling fluid therethrough.

In an end portion of the structure, the tubes are preferably disposed in a telescopic array with the innermost tube protruding at the greatest length.

It is a feature of this invention to provide optimized zig-zag insulating paths between the inner and outer conductors. The symmetrical, staggered arrangement of the contact lines reduces the possibility of "short-cuts", or preferred routes for treeing or tracing since the radially extending supports are divided by circumferentially disposed substantially equipotential sections of the tubes. The sections, being substantially equidistant to the inner conductor, are effective in reducing the propagation of the insulation-damaging phenomena.

BRIEF DESCRIPTION OF THE DRAWINGS

The invention will be explained in more detail in conjunction with the drawings in which.

Figure 4:
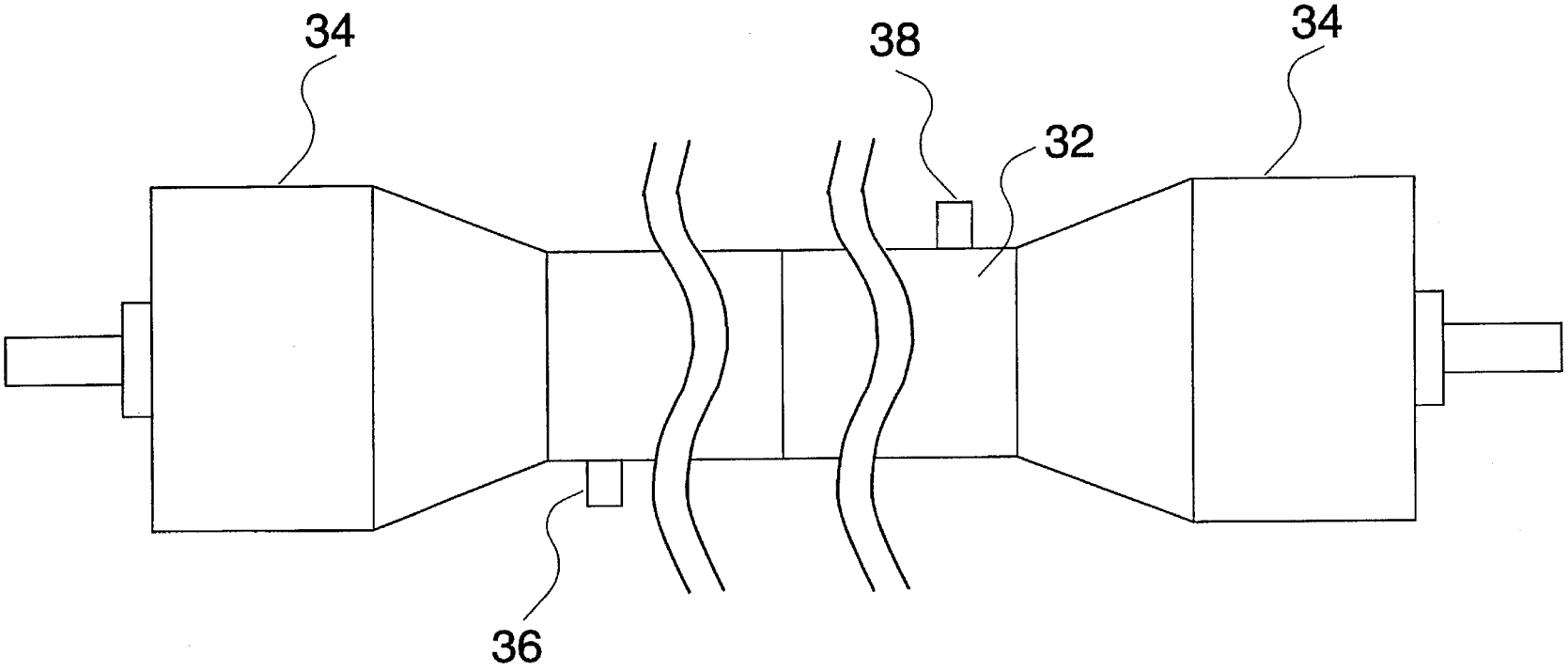
FIG. 4 is a side view of a coaxial hv cable with the insulating structure.

FIG. **4*a* is a cross sectional view of the cable of FIG. 4**

Figure 1:
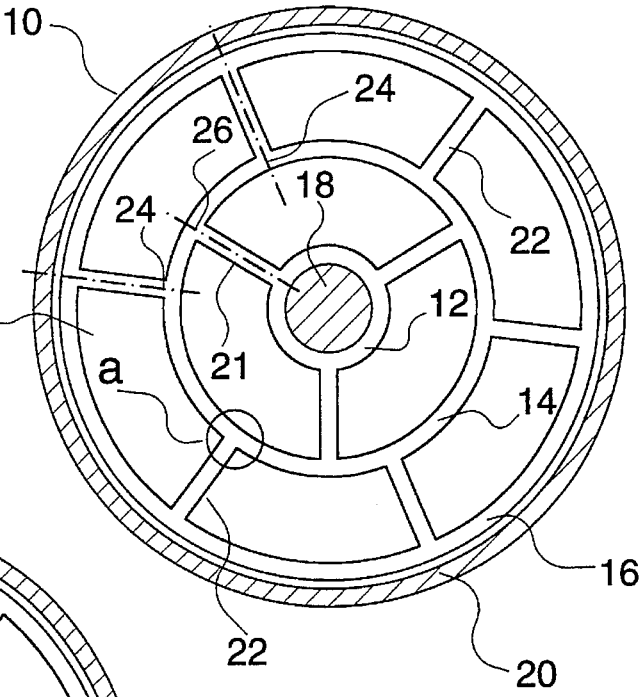
FIG. 1 is a cross-sectional view of an embodiment of the insulating structure of the invention.
Figure 5:
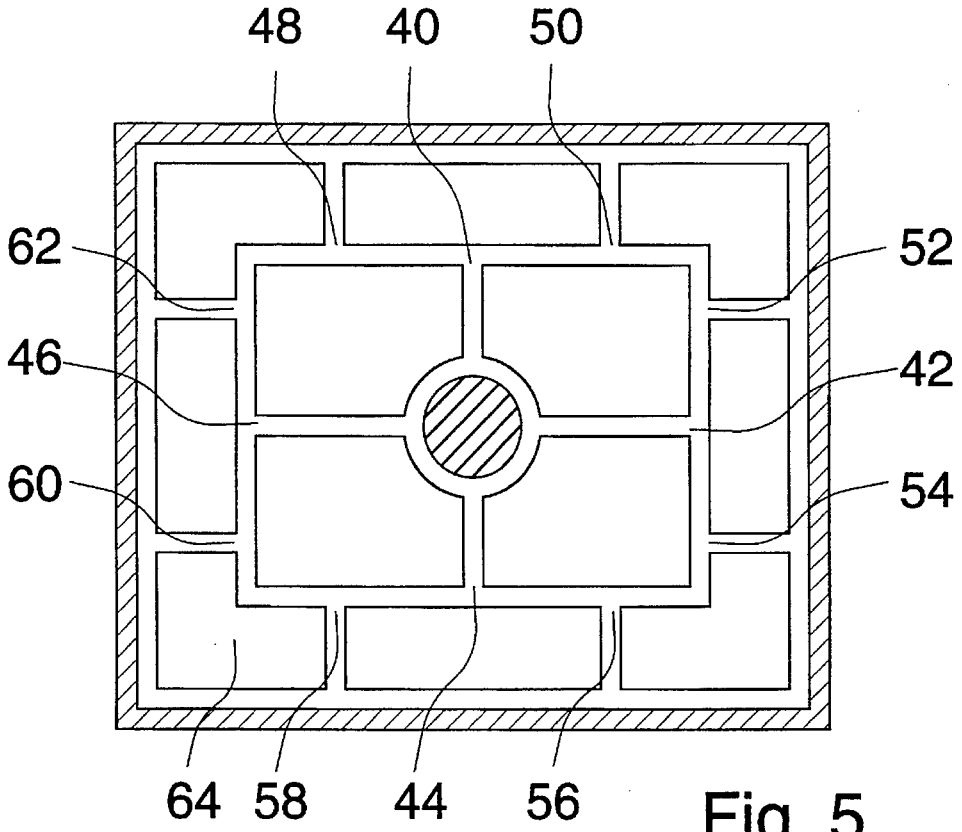
Figure 6:
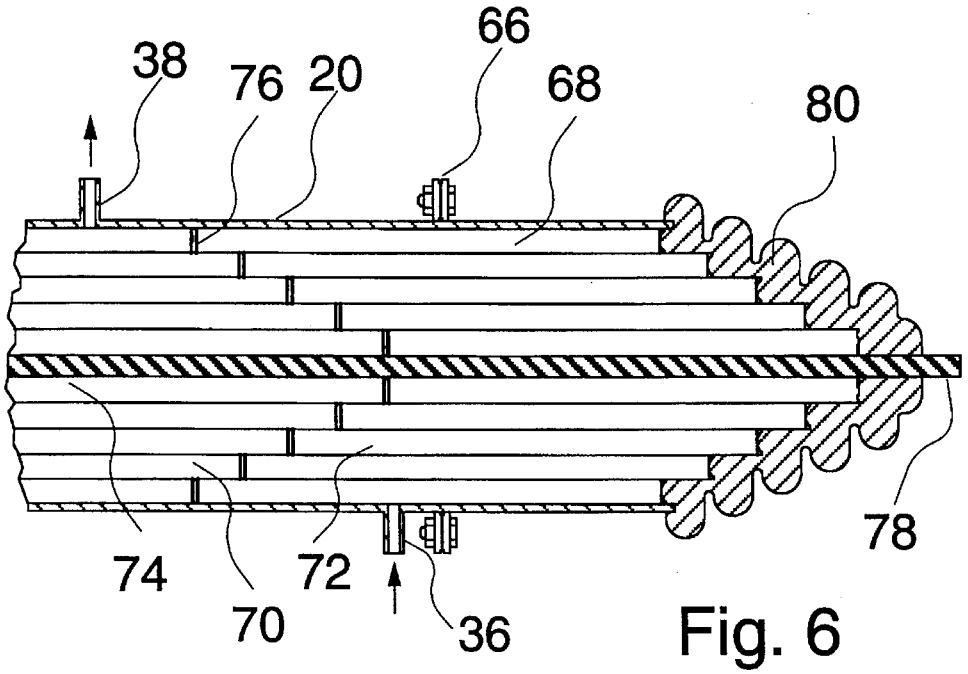

FIG. 5 is a cross-sectional view of an end portion of the insulating structure of FIG. 4;

FIG. 6 is a view in partial cross section of an embodiment of the structure of the invention illustrating cooling means;

FIG. 7 is an enlarged view of detail "a" of FIG. 1;

FIG. 8 is a cross-sectional view of yet another embodiment of the invention employing nonlinear insulating means.

Figure 9:
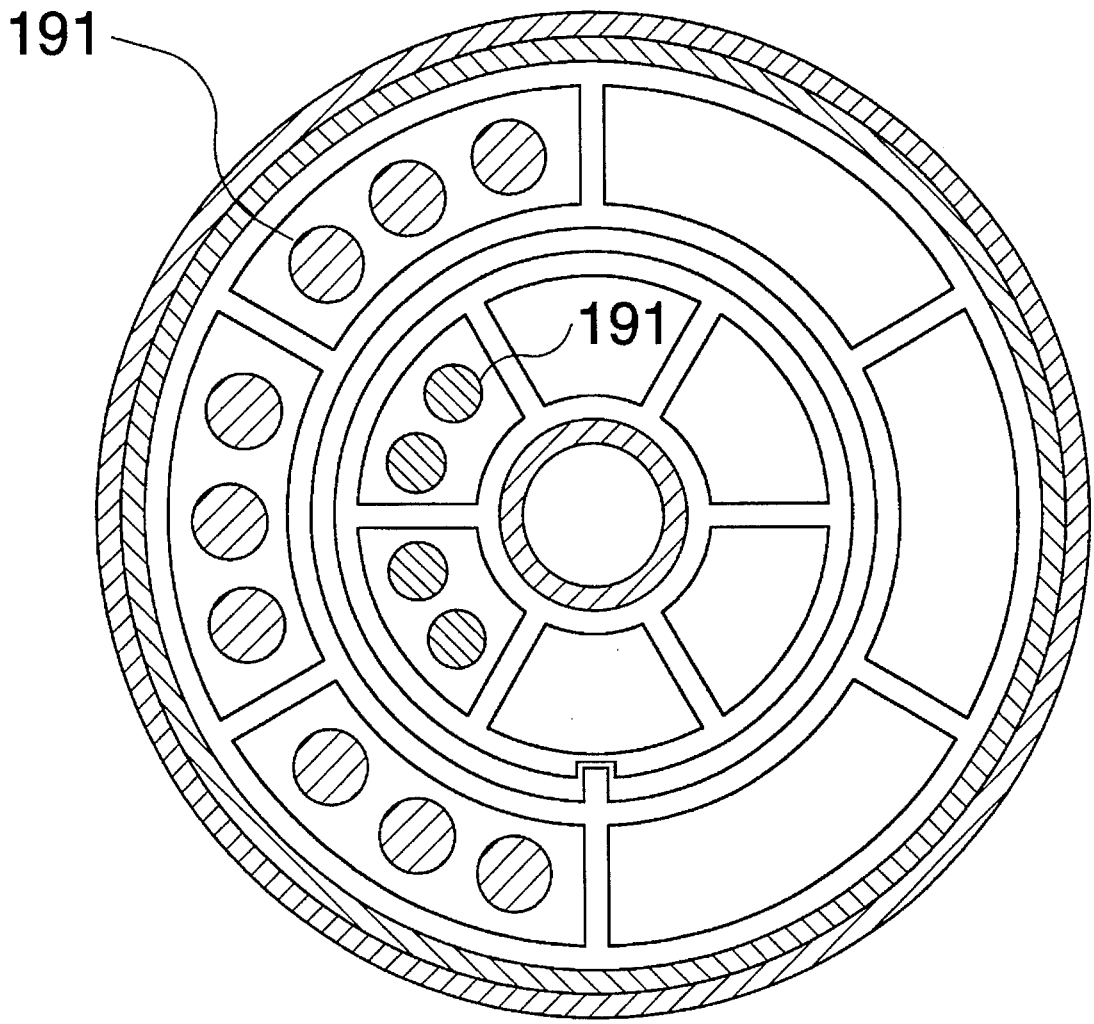
Figure 10:
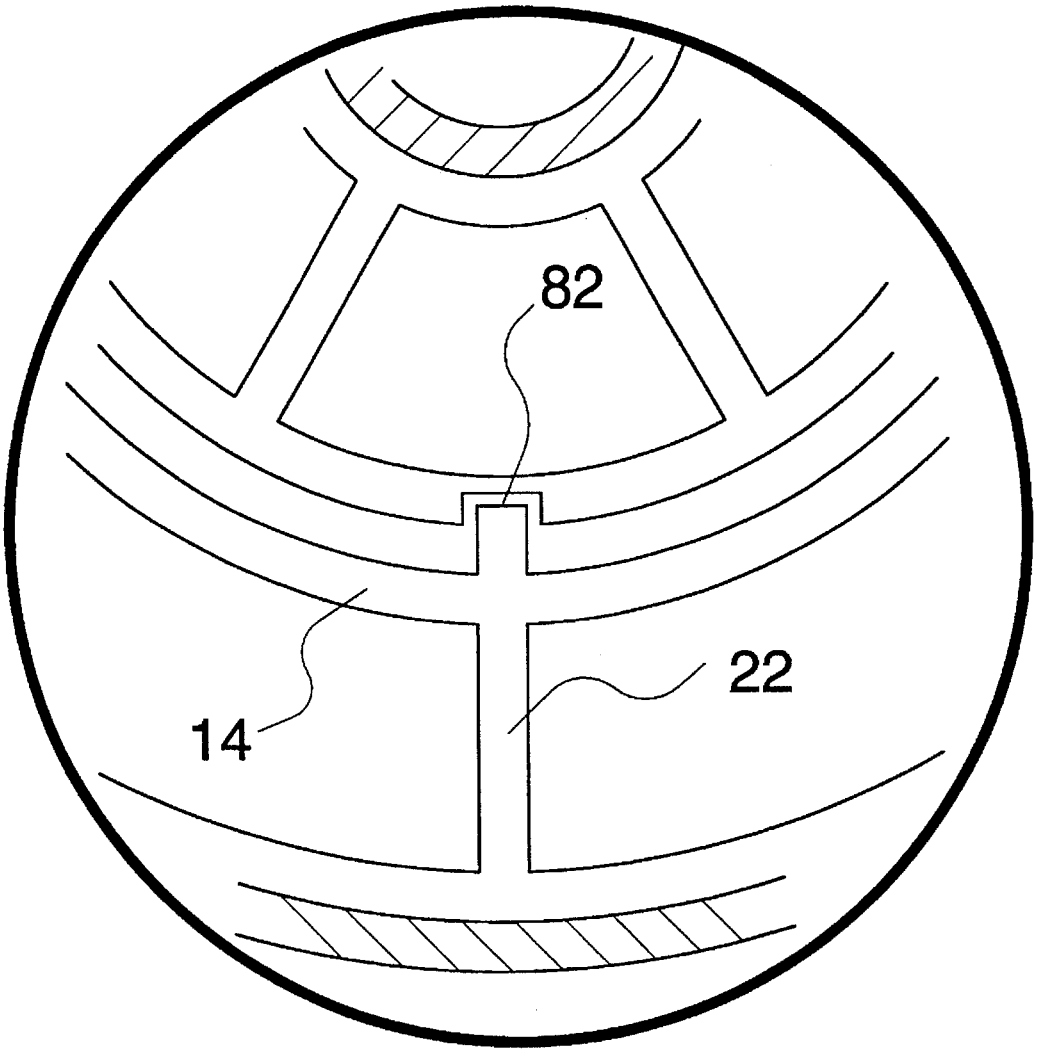
Figure 11:
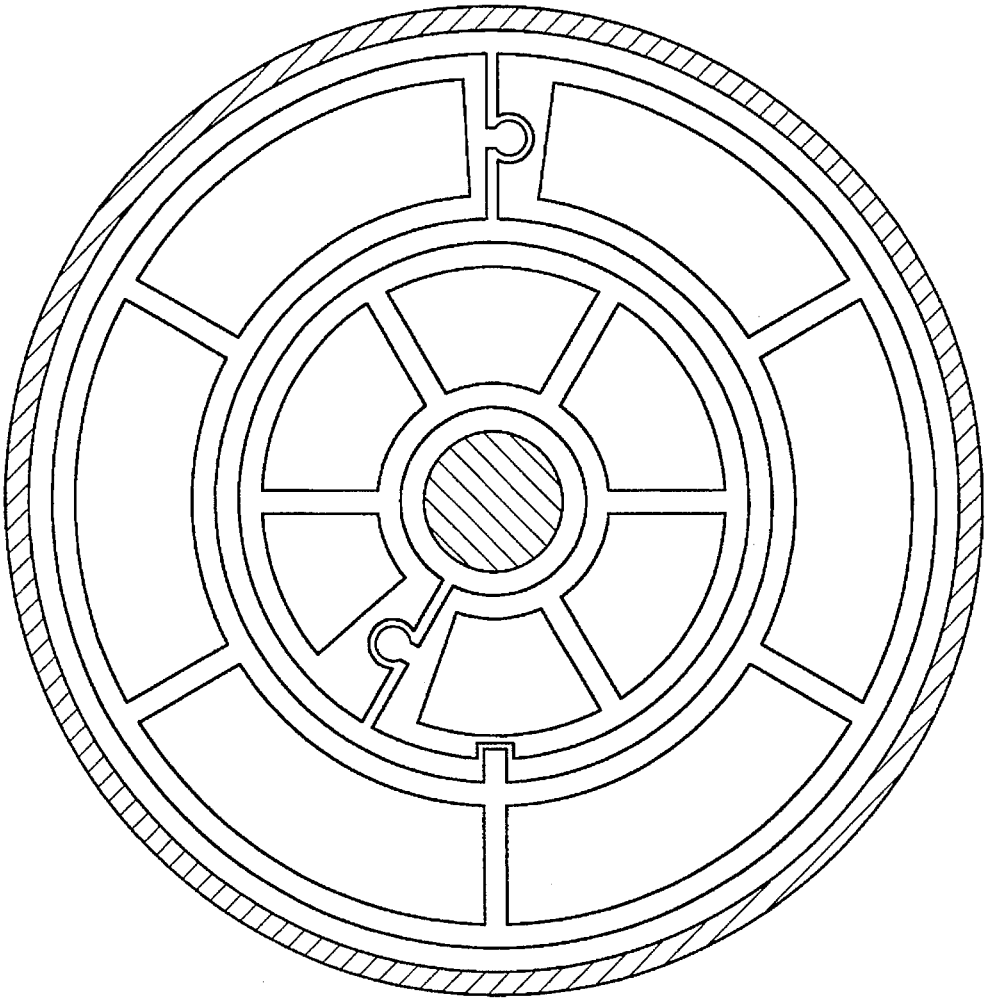
Figure 12A:
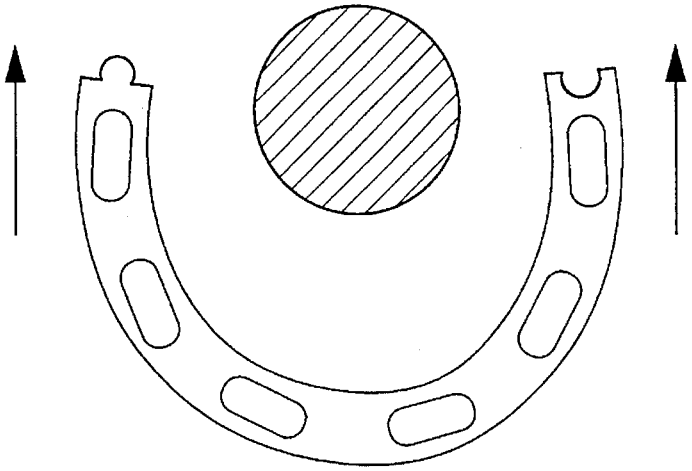
Figure 12B:
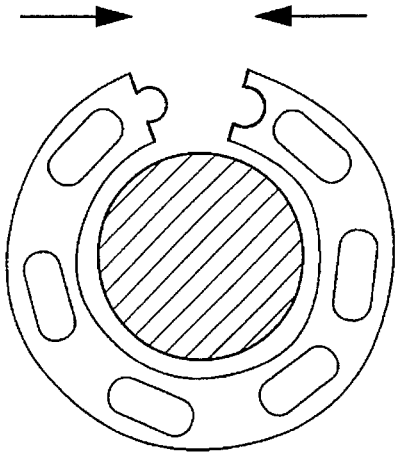
Figure 12C:
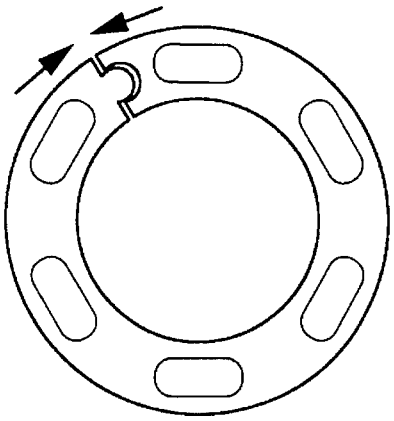

FIG. 9 is a cross-sectional view of another embodiment of the insulating structure of the invention;

FIG. 10 is an enlarged view of a groove mechanism shown in FIG. 9;

FIG. 11 is a cross-sectional view of another embodiment of the insulating structure of the invention;

FIGS. 12*a*, 12*b* and 12*c* are simplified cross-sectional views of the assembly of the embodiment shown in FIG. 11.

DETAILED DESCRIPTION OF PREFERRED EMBODIMENTS

The insulating structure of the invention does not include the inner and outer conducting elements. It is designed to accommodate the elements and can be made integral therewith.

It is preferable to manufacture the insulating structure by extrusion from a polymeric material having adequate insulating properties. Such material are known in the art of electrical insulation. For simplicity, all the elements of the insulating structure can be manufacture from one type of material (except for non-linear insulation and ferrite), but it is conceivable to use a variety of materials if needed.

Turning now to the drawings, FIG. 1 illustrates an exemplary insulating structure of the invention, generally designated 10. In this cross-sectional view, the structure is shown to include three concentric tubes 12, 14, and 16. The innermost tube 12 defines a cylindrical space 18 occupied by an inner conductor, not shown. The outermost tube 16 is surrounded by a cylindrical outer conductor 20. The intermediate tube 14 is spaced between the other tubes 12, 16, by means of ribs 21, 22. The ribs extending between the tubes 13 and 14 are spaced uniformly around the periphery of the tubes 12 and 14 thereby defining an angle $\alpha=120°$ therebetween.

The symmetry lines of the ribs 21, 22 define contact lines 24, 26 of the ribs with the respective tubes. The contact lines are seen FIG. 1 as dots only which is sufficient for the purpose of the following explanation.

One of the advantages of the invention is realized when the contact point 26 of the rib 21 is situated symmetrically, or half-way between contact points 24 of the ribs 22 with the intermediate tube 14. This feature reduces the possibility of voltage breakdown compared to an analogous insulating structure where the adjacent contact lines are located at random, and where a result, treeing and tracking of insulation can be accelerated. This risk is due to the fact that electric stress is propagated relatively easily in the radial direction of the inner conductor towards the outer conductor, while the propagation is slowed or stopped in those sections of the insulation which are disposed circumferentially, i.e. orthogonally or nearly orthogonally to the radial direction.

Thus, the above feature of the invention maximizes the advantageous effect of the zig-zag insulating structure by eliminating the "shortcuts".

The location of the contact lines on the innermost tube 12 and the outermost tube 16 is understandably of lesser importance. IT is advantageous to keep the number of ribs between the innermost and the adjacent tube from 3 to about 6 with that number ususally greater in the consecutive layers.

Figure 2:
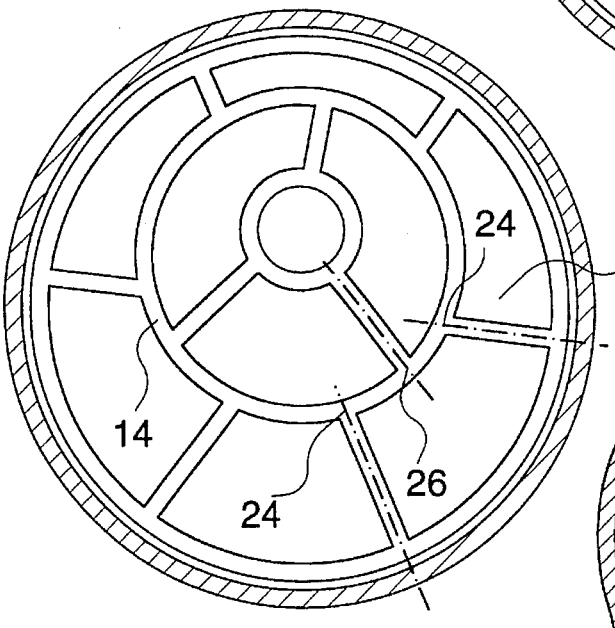
FIG. 2 is a cross-sectional view of another embodiment of the structure.

In FIG. 2, an alternative arrangement of the insulating structure is shown wherein the tubes are non-concentric. However, the condition of the symmetric location of the contact line 26 relative to contact lines 24 still applies to all the rib locations on the intermediate tube 14.

Figure 3:
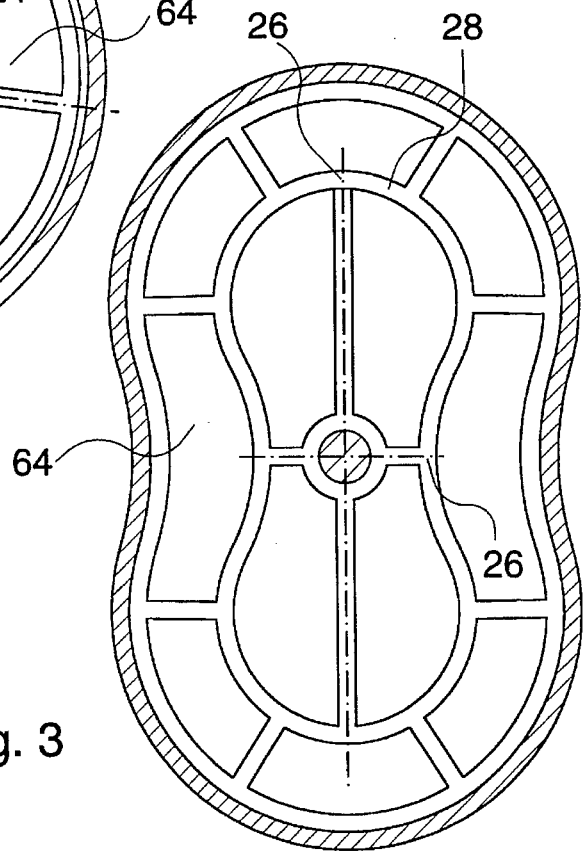
FIG. 3 is a cross-section of still another embodiment of the structure.

Beside circular, polygonal and other tubular profiles are also usable for the purpose of the invention. FIG. 3 shows an arrangement in which one central inner conductor is in the geometric center of the insulating tubes. As in FIG. 2, this non-concentric arrangement may cause the ribs to extend in an off-radial direction to meet the above explained criterion of the symmetrical position of the contact lines 26 relative to nearest contact lines on the opposite side of the intermediate tube 28.

While FIGS. 1–3 illustrate cross-sectional views of the structure of the invention, FIG. 4 shows schematically a coaxial cable utilizing the insulating structure. The cable consists of a cylindrical main portion 32 and two rectangular end portions 34. Two connectors, an inlet 36 and an outlet 38 are mounted onto the structure to enable a high voltage cooling medium, such high-pressure gas to be passed therethrough.

Figure 4A:
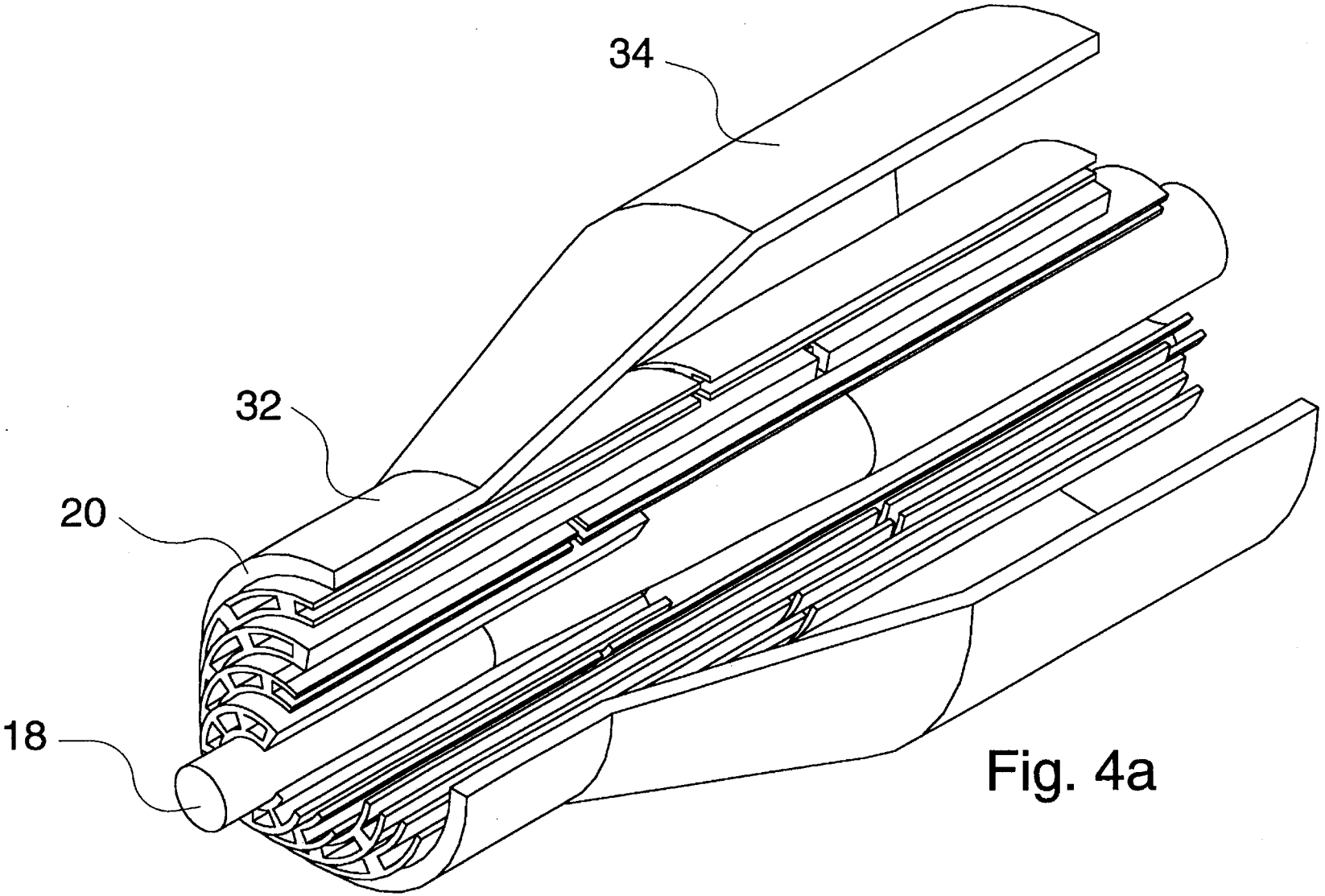

The end portions 34 may be square, rectangular, or cylindrical in cross section, as shown in FIG. 4*a*. This structure is particularly advantageous for example, when connecting a radiating structure such as an antenna to a high voltage coaxial line; and when a parallel connection of two or more coaxial lines is to be made. The orderly arrangment of the insulating layers proposed in this invention, as can be seen in FIG. 4*a*, provides means for a high voltage system to have wide bandwidth and high breakdown voltage at the same time.

FIG. 5 illustrates an embodiment of the structure, with a rectangular cross-section (the outside conductor is not shown) which can be utilized either as an end portion 34 (FIG. 4 and FIG. 4*a*) or throughout the entire length of the structure, depending on the specific requirements. It can be seen that the above-discussed feature is present in this embodiment as the points 40, 42, 44 and 46 are located half-way between points 48 and 50; 52 and 54; 56 and 58; 60 and 62 respectively.

The adjacent tubes 12 and 14 or 14 and 16, and the ribs 21, 22, define open channels 64 (FIGS. 1,2,3 and 5) which extend over the entire length of the structure subject to certain limitations as explained below. As shown in FIG. 4 and FIG. 6, the structure may comprise an inlet 36 and an outlet 38 for supplying and removing high-pressure cooling medium. The straight-linear shape of the channels 64 creates less flow resistance to the cooling medium (gas or liquid) than helical channels.

FIG. 6 illustrates a number of features of the present invention. The outer conductor 20 is shown to have connecting means, e.g. flange connections 66 to enable the structure to be disassembled into separate modules. Concentric tubular sections with ribs 68, 70, 72 and 74 are of the same length and are arranged telescopically. When assembled, as shown in FIG. 6, the ends of adjacent modules abut each other at staggered locations 76. Of course, the rib arrangement in the modules thus interconnected must be identical. To facilitate the positioning of modules during assembly, grooves (not shown) or other guiding means may be provided in the respective tubes. The abutment of the modules is not airtight so that fluid can pass through all the channels 64 of the structure.

The assembled structure is secured by the use of the flange connection 66. The telescopic end section of the insulating structure, along with the inner conductor 78 and the outer conductor 20, is sealed by means of a ceramic bushing 80. The embodiment of FIG. 6 illustrates the advantages of the modular design of the structure and the possibility of its effective cooling with some sacrifice in the flexibility of the structure.

FIG. 7 explains the concept of stackability of the modules illustrated in FIG. 6. In an exemplary non-limiting embodiment of the invention, grooves 82 may be provided in the surfaces of the tubes 14, at the lines of contact of the tubes with the respective ribs 22. With proper design, the ribs can slide in the grooves and thus ensure axial displacement of the tubes relative to each other. As a result, the matching of the modules (FIG. 6) can be accomplished tube-by-tube rather than by forcing the entire module against the adjacent one.

The embodiment shown in FIG. 8 shows the inner conductor 78, innermost tube 12, intermediate tube 14 and the outermost tube 16. A layer of non-linear insulation 84, made of a semiconductor material, surrounds the inner conductor 78 which provides the function of inhibiting treeing. Another layer 86 of non-linear insulating material, for example a semiconducting material, separates the outermost tube 16 from the outer conductor 88.

In another embodiment of this invention, the circular, polygonal, and other tubular profiles, can incorporate insulating that consists of extruded polymeric material in the form shown in FIG. 9. Referring to FIG. 9, an insulating structure is shown in which two or more concentric tubes are inserted on top of one another having a tongue and groove portion as shown in FIG. 10 for positioning the tubes in place. The addition of a locking mechanism as shown in FIG. 11 allows the creation of a high voltage structure that will allow construction of extremely long high voltage cables. The locking mechanism of FIG. 11 in combination with the tongue and groove mechanism described heretofore, allow assembly of extremely long high voltage lines, by a process illustrated in FIGS. 12*a*, 12*b* and 12*c*. Referring to FIGS. 12 the insertion is shown, of consecutive layers of insulating tubular profiles by opening them prior to insertion of an adjacent insulating tube. The locking mechanism allows structural stability and allows greater flexibility of the embodiment shown.

The specific dimensions of the insulating structure depend on the application and can be determined by routine calculations.

An optional layer of ferrite, may be positioned between the inner conductor and the outer conductor. In the preferred embodiment, the ferrite layer serves to lessen the frequency response of a transmitted pulsed signal.

While those skilled in the art will perceive various changes modifications in the embodiments of the invention, it is understood that all matter herein shown or described shall be deemed illustrative and not limiting the scope of the invention as set forth in the claims.

I claim:

1. An insulating structure for insulating and spacing an inner conductor from an outer conductor comprising:

a plurality of linearly and radially interspaced tubes of insulating material, disposed one inside another, including an innermost tube, an outermost tube, and at least one intermediate tube disposed therebetween, the innermost tube surrounding said inner conductor and the outermost tube adjacent to the outer conductor, a plurality of insulating spacing supports extending between facing surfaces of adjacent tubes, each of such supports contacting said facing surfaces along longitudinal axial contact lines, said contact lines on an inner side of each intermediate tube being axially spaced and located substantially half-way between two nearest contact lines on the outer side of said intermediate tube.

2. An insulating structure of claim 1 wherein at least some of said tubes are polygonal in cross section at least over a portion of the length thereof.

3. An insulating structure of claim 1 wherein the tubes are essentially circular in cross section.

4. An insulating structure of claim 1 wherein the spacing between adjacent tubes varies along their periphery.

5. An insulating structure according to claim 2, and having two end portions at which the tubes are rectangular in cross section.

6. An insulating structure according to claim 1 wherein the number of the spacing supports between the innermost tube and the adjacent tube is from three to six.

7. An insulating structure according to claim 1 further comprising means for axial displacement of at least some of the tubes relative to each other.

8. An insulating structure according to claim 1 defining a number of stackable modules.

9. An insulating structure according to clam 7 defining a number of stackable modules.

10. An insulating structure according to claim 1 wherein at least some of the adjacent tubes and the respective spacing supports therebetween define open channels extending along the entire length of said structure, the structure comprising an inlet and an outlet in communication with said channels for the passage of cooling fluid therethrough.

11. An insulating structure according to claim 1 further comprising a layer of non-linear insulating material surrounding said inner conductor.

12. An insulating structure according to claim 1 further comprising a layer of non-linear insulating material disposed inside and adjacent to said outer conductor.

13. An insulating structure according to claim 1 further comprising a layer of ferrite disposed between said inner conductor and said outer conductor, for limiting the frequency response of a signal passing through one of the conductors.

14. An insulating structure for insulating and spacing inner conductor from an outer conductor comprising:

a plurality off hollow-walled tubes of insulting material, disposed in telescoping arrangement, including an innermost tube, an outermost tube, and at least one intermediate tube disposed therebetween, the innermost tube surrounding said inner conductor and the outermost tube adjacent to the outer conductor;

each tube having a plurality of insulating spacing supports extending between the inner surfaces of its annulus, each support contacting said surfaces along longitudinal axial contact lines;

the tubes being positioned in axially staggered relationship whereby a high resistance, low leakage coupling is provided for connection to a similar structure.

* * * * *